US007044678B2

(12) United States Patent
Papousek et al.

(10) Patent No.: US 7,044,678 B2
(45) Date of Patent: May 16, 2006

(54) CONNECTING AN ANCHORING ROD TO A DRILLING TOOL

(75) Inventors: Hannes Papousek, Brückl (AT); Herbert Papousek, Jr., St. Magdalen bei Villach (AT)

(73) Assignee: Atlas Copco MAI GmbH, Feistritz an der Drau (AT)

( * ) Notice: Subject to any disclaimer, the term of this patent is extended or adjusted under 35 U.S.C. 154(b) by 155 days.

(21) Appl. No.: 10/484,270

(22) PCT Filed: Jul. 19, 2001

(86) PCT No.: PCT/AT01/00247

§ 371 (c)(1),
(2), (4) Date: May 13, 2004

(87) PCT Pub. No.: WO03/008763

PCT Pub. Date: Jan. 30, 2003

(65) Prior Publication Data

US 2004/0184872 A1 Sep. 23, 2004

(51) Int. Cl.
*F16D 1/00* (2006.01)

(52) U.S. Cl. ..... 403/300; 403/307; 403/306; 403/313

(58) Field of Classification Search ..... 403/300–307, 403/313
See application file for complete search history.

(56) References Cited

U.S. PATENT DOCUMENTS

| | | | | |
|---|---|---|---|---|
| 4,332,502 A | | 6/1982 | Wormald et al. | |
| 5,411,347 A | * | 5/1995 | Bowmer et al. | 403/305 |
| 5,888,025 A | | 3/1999 | Papousek | |
| 2002/0076273 A1 | * | 6/2002 | Carstensen | 403/305 |

FOREIGN PATENT DOCUMENTS

| | | |
|---|---|---|
| EP | 0 391 119 | 10/1990 |
| EP | 0 391 119 A1 | 10/1990 |

* cited by examiner

*Primary Examiner*—John R. Cottingham
(74) *Attorney, Agent, or Firm*—Young & Thompson

(57) ABSTRACT

An anchoring rod for rock anchoring (self-drilling injection bolts), includes an outer thread for connecting the anchoring rod to a drilling tool via a coupling sleeve. The end of the anchoring rod, which is screwed into the coupling sleeve, comprises a section which has a reduced diameter in comparison with the outer diameter of the anchoring rod. The free end of the section of the anchoring rod with the reduced diameter comprises a bevel. An open space is thus formed between the inner surface of the coupling sleeve and the reduced diameter end of the anchoring rod. The space stops the anchoring rod from becoming stuck in the coupling sleeve, even when the end of the rod is plastically deformed during the drilling process, so that the anchoring rod can be unscrewed from the coupling sleeve without applying significant force.

20 Claims, 4 Drawing Sheets

CONNECTING AN ANCHORING ROD TO A DRILLING TOOL

BACKGROUND OF THE INVENTION

The invention relates to the connection of an anchor rod to a drilling tool of a device for setting of self-drilling injection bolts.

In order to be able to install self-drilling injection bolts in rock, it is necessary for the anchor rods comprising the bolt system to be connected to the drilling head of a drilling tool. The connection is made via a transition sleeve into which one end of the anchor rod is screwed and which is coupled to the insertion end of the drilling tool, for example, by screwing on. A drill bit is screwed on the frontmost end of the first anchor rod. As the depth of the bore hole progresses the anchor rod is lengthened by screwing on connecting couplings and other anchor rods until the total bolt length is reached. When an anchor rod is used, it is necessary to break the connection between the last anchor rod which has been drilled in the rock and the drilling tool by the last anchor rod which is projecting out of the bore hole being screwed out on the transition sleeve and a new anchor rod being inserted, and the latter must be lengthened with the last anchor rod by a connecting coupling and must be screwed into the transition sleeve of the drilling tool.

The release first of the anchor rod from the transition sleeve on the drilling tool proved to be a problem in the prior art. In the known execution of the ends of the anchor rods it often happens that the anchor rod sticks in the transition sleeve which connects it to the drilling tool; this leads to disruptions in operation since considerable force and time are necessary to break the screw connection between the anchor rod and the transition sleeve. The reason for the sticking which often occurs is that anchor rods which have not been heat treated compared to drill collars which are always used in tempered quality have low hardness. The transition sleeve of the drilling tool, which sleeve is likewise always tempered, since it is designed for repeated use, is much harder than the anchor rods. During operation, therefore while drilling, residual deformation of the end of the anchor rod held in the transition sleeve is caused by the process of rotary percussive drilling (rotary motion and percussive motion), by which the aforementioned problem of sticking of anchor rods in the transition sleeve arises.

U.S. Pat. No. 4,332,502 A discloses forming unthreaded sections on the ends of anchor rods for anchor rods which are to be connected to one another by connecting couplings. The anchor rods are connected to one another in U.S. Pat. No. 4,332,502 A by connecting couplings which, in the area in which the anchor rods which have been screwed into the connecting couplings, adjoin one another with their unthreaded sections, have a ring which projects to the inside and into which the unthreaded ends of the anchor rods which have been screwed into the transition sleeve fit. This means that in the case of percussive loads on the anchor rods as occurs in the setting of roof bolts, when bore holes are produced with them, deformations will occur mainly in the area of the adjoining ends, therefore in the area of the unthreaded sections of the anchor rods so that the unthreaded sections of the anchor rods are flattened and mushroomed as their diameter increases. These deformations will result in that the sticking between the anchor rods and the sleeve which was considered disadvantageous above will occur.

SUMMARY OF THE INVENTION

The object of the invention is to make the end of the anchor rods which is held in the transition sleeve on the drilling tool such that the described sticking does not occur.

Preferred and advantageous embodiments are the subject matter of the dependent claims.

In contrast to the known anchor rods in which the ends are (slightly) chamfered, at least one end of the anchor rod as claimed in the invention is provided with a section which has a tapered diameter. This section which is provided on the anchor rod at least on its end which is held in the transition sleeve of the drilling tool (screwed into it) can have a cylindrical outside surface and for its part have a chamfer on the end face.

The execution of at least one end of the anchor rods as claimed in the invention results in unobstructed release (screwing out) of the anchor rods from the transition sleeves because the deformations of the end of the anchor rod, which end is held in the transition sleeve, and which deformations occur when the drill bolts are set under the action of the loads which occur during drilling, due to the empty space between the inside surface of the transition sleeve and the section of the end of the anchor rod made with a smaller diameter cannot lead to sticking of the anchor rods in the transition sleeve.

In the invention, screwing the connecting couplings onto the end of the last anchor rod, which end projects out of the bore hole, is without difficulty because between the tapered end of the anchor rod and the inside surface of the connecting coupling there is also play when the end of the anchor rod has been deformed.

The advantage for the user of the connection as claimed in the invention between the anchor rod and the drilling tool is first of all that longer interruptions in operation are avoided since the anchor rod can be easily released from the transition sleeve so that operation without disruptions is ensured. With consideration of the fact that when building tunnels or in stabilizing a slope, drilling hammers often operate at a relatively large ground interval, achieving the object as claimed in the invention (preventing the sticking between the transition sleeve and the anchor rod) is of considerable importance, since correcting a problem at a greater height constitutes a not inconsiderable safety risk.

Other details, features and advantages of the invention follow from the description below.

DESCRIPTION OF THE PREFERRED EMBODIMENTS

Figure 1:
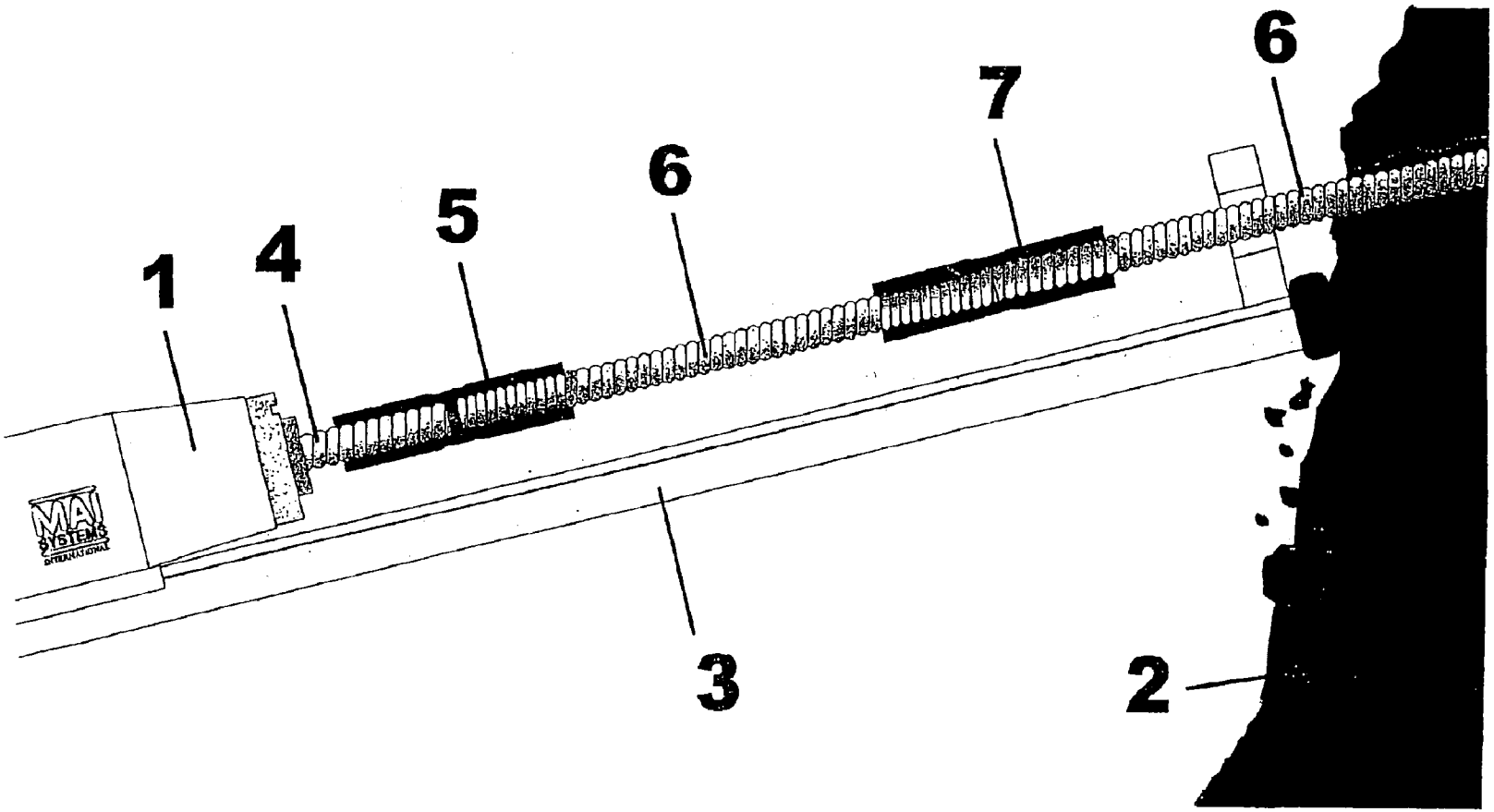
FIG. 1 schematically shows a drilling hammer while drilling.

The drilling hammer shown in FIG. 1 consists of a drilling tool 1 which is advanced on the guide of the drilling carriage 3, which guide is supported on the rock 2, according to the progression of drilling. The drive which is intended for this purpose is not shown. On the insertion end 4 of the drilling tool 1 an anchor rod 6 is screwed in via a transition sleeve 5 and the rod is connected via connecting couplings 7 either directly to the anchor rod which bears the drill bit or, depending on the progression of the drilling, other anchor rods 6.

Via a connecting part a flushing liquid and after completed drilling for fixing the bolt a (hydraulically) setting medium can be delivered into the anchor rods 6 and after setting the medium it fixes the bolt which consists of a corresponding number of anchor rods 6 in the bore hole.

Figure 2:
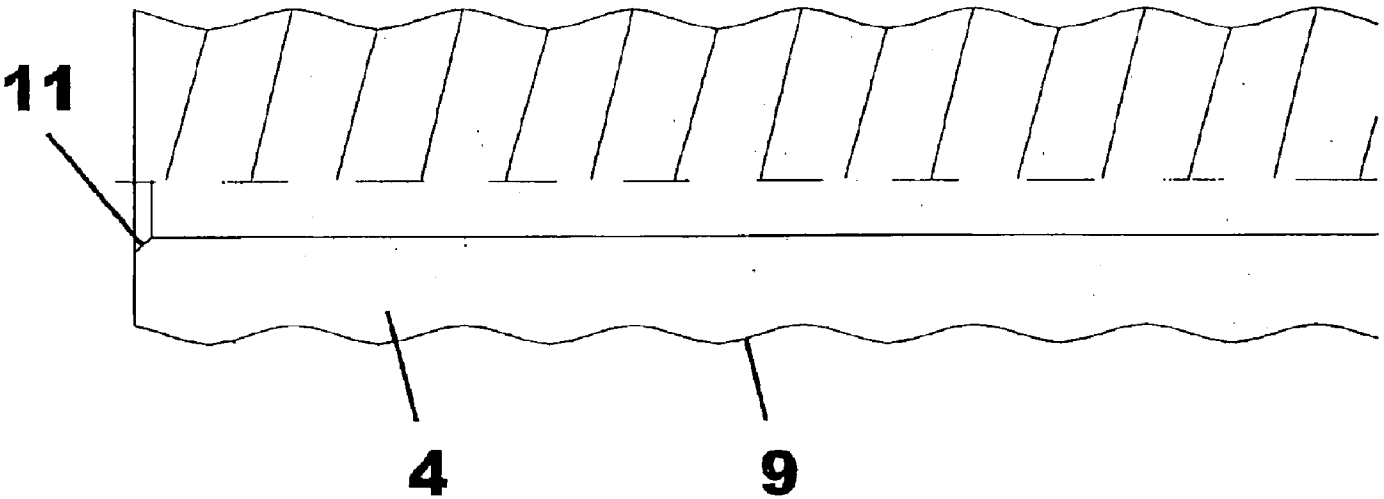
FIG. 2 shows a known anchor rod.

FIG. 2 shows one end of a known anchor rod 6 which has an outside thread 9 due to the corresponding shaping of its wall. The end of the known anchor rod is provided with a 45° chamfer 11.

Figure 3:
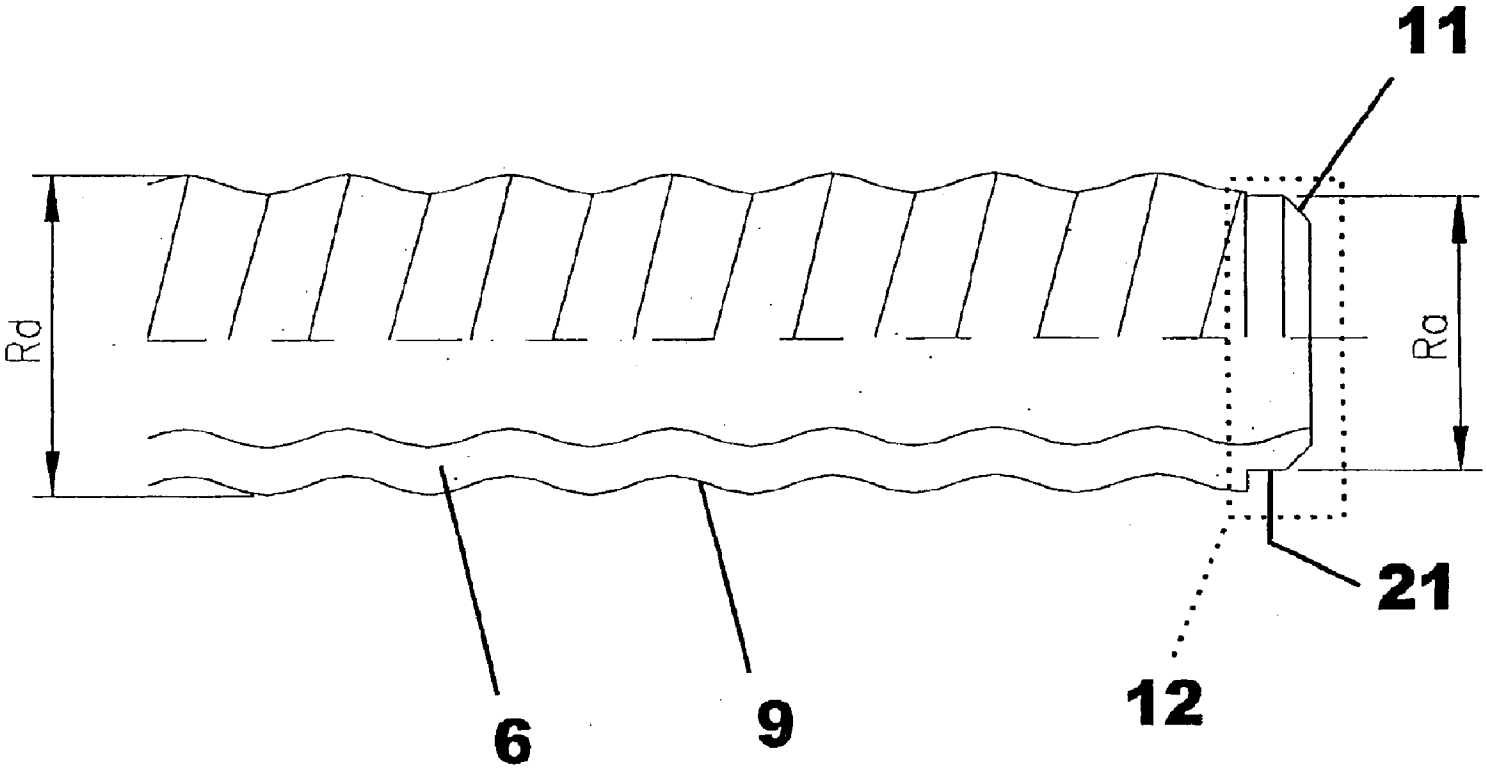
FIG. 3 the end of an anchor rod with an end with a tapered diameter.
Figure 4:
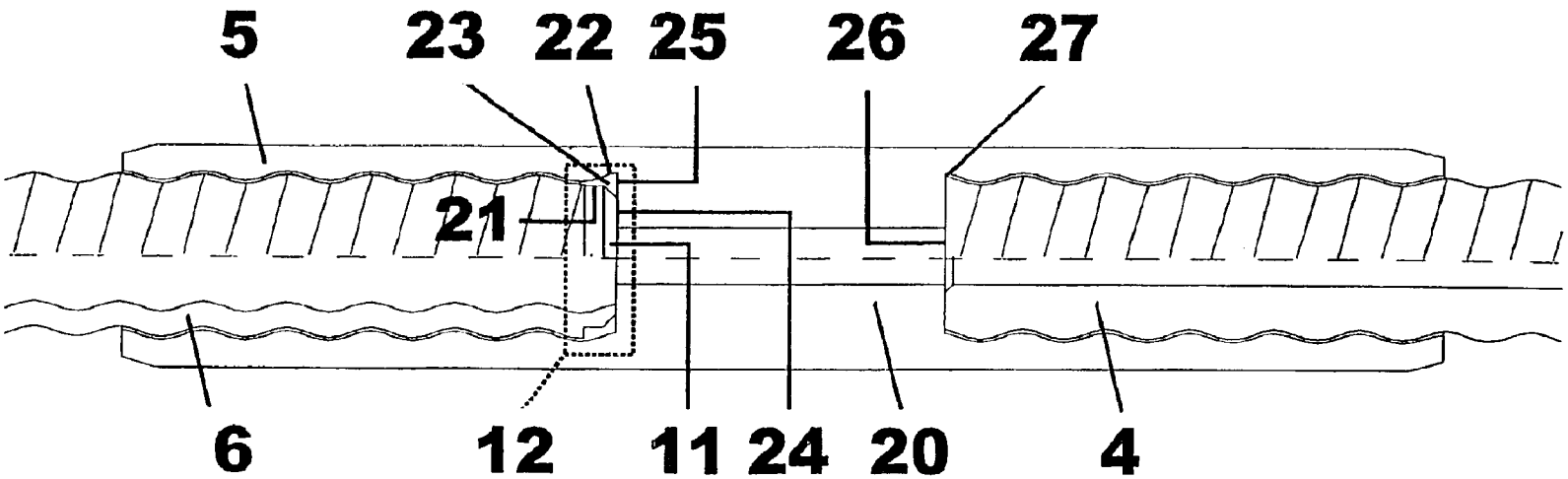
FIG. 4 shows in a section one end of an anchor rod which has been screwed into a transition sleeve.

In the anchor rod 6 as claimed in the invention at least one end is made as is shown in FIG. 3 and has a section 12 which has a diameter Ra which has been reduced compared to the outside diameter (Rd) of the anchor rod 6 and does not bear an outside thread 9. The free end of the section 12 of the anchor rod 6 with the reduced diameter Ra can likewise be provided with a 45° chamfer 11. One efficient configuration is possible for at least the end of the anchor rod 6, which end is screwed into the transition sleeve 5, but not essential, especially when the anchor rod 6 consists of hardened steel (like the transition sleeve 5).

The outside shape of the section 12 with the reduced diameter is optional, but will often be made in the shape of a cylindrical jacket. The section 15 can also be made tapering conically toward the free end, the outside contour being tilted by not more than 20 degrees to the lengthwise axis of the anchor rod 6.

The transition sleeve 5 which is screwed onto the insertion end 4 of the driven or output shaft 4 of the drilling tool 1 consists preferably of hardened steel and in its middle has an annular rib 20 which projects inward. The clear cross section of the annular rib 20 is essentially the same size as the clear cross section of the anchor rods 8.

Between the outside surface 21 of the tapered section 12 of the anchor rod 6 and the inside surface 22 of the transition sleeve 5 there is an empty space 23. This empty space 23 allows plastic deformation of the tapered section 12 which is provided on the end of the anchor rod 6 without the anchor rod 6 (or the anchor rod 8) sticking in the transition sleeve 5.

The anchor rod 6 with its end face 24 lies on the lateral annular surface 25 of the annular rib 20. The insertion end 4 of the drilling tool 1 lies with its end surface 26 on the other annular surface 27 of the annular rib 20.

In summary, one embodiment of the invention can be described as follows:

An anchor rod 6 for roof bolts (self-drilling injection bolts) has an outside thread 9 for connecting the anchor rod 6 to a drilling tool 1 via a transition sleeve 5. The end of the anchor rod 6 which has been screwed into the transition sleeve 5 has a section 12 with a diameter which is smaller than the outside diameter of the anchor rod 6. The section 12 of the anchor rod 6 with the tapered diameter has on its free end a chamfer 11. For this reason, between the inside surface 22 of the transition sleeve 5 and the end of the anchor rod 6 with a tapered diameter there is an empty space 23 which prevents the anchor rod 6, even if its end is plastically deformed during drilling, from sticking in the transition sleeve 5 so that the anchor rod 6 can be screwed out of the transition sleeve 5 without increased expenditure of force.

What is claimed is:

1. Connection of an anchor rod (6) to a drilling tool (1), comprising:

a transition sleeve (5) having an inside surface comprising a first end passage and a second end passage, each of the first end passage and the second end passage comprising a terminal interior side surface (25, 26) orthogonal to a length of the corresponding passage, the terminal interior side surfaces (25, 26) of the first and second end passages being defined by end surfaces of an interior annular rib (20) projecting into the interior of the transition sleeve (5), the transition sleeve (5) connected, at the first end passage, to the insertion end (4) of the drilling tool (1) and having screwed into the second end passage a first end portion of the anchor rod (6) wherein, at least the first end portion of the anchor rod (6) which is screwed into the second end passage of the transition sleeve (5) has a section (12) with an end length having a diameter (Ra) tapered as compared to the outside diameter (Rd) of the anchor rod (6) such that between the inside surface (23) of the transition sleeve (5) and the section (12) of the anchor rod (6) there is an empty space (23), the section (12) of the anchor rod (6) has a end face (24) facing the terminal interior side surface (25) of the first end passage, the empty space is located adjacent the end face of the section, and the entire end length of the section (12) of the anchor rod (6) with the tapered diameter (Ra) is free of threads.

2. Connection as claimed in claim 1, wherein the section (12) of the anchor rod (6) with the tapered diameter (Ra) on its free end has a chamfer (11) or a radius.

3. Connection as claimed in claim 1, wherein the outside shape of the section (12) with the tapered diameter (Ra) is in the shape of a cylindrical jacket.

4. Connection as claimed in claim 1, wherein the outside shape of the section (12) with the tapered diameter (Ra) is conical.

5. Connection as claimed in claim 4, wherein the section (12) tapers toward the end of the anchor rod (6).

6. Connection as claimed in claim 4, wherein the outside shape of the section (12) is tilted by at most 20° to the lengthwise axis of the anchor rod (6).

7. Connection as claimed in claim 1, wherein the section (12) of the anchor rod (6) with the tapered diameter (Ra) on its free end has a chamfer (11) or a radius.

8. Connection as claimed in claim 5, wherein the outside shape of the section (12) is tilted by at most 20° to the lengthwise axis of the anchor rod (6).

9. A connection of an anchor rod (6) to a drilling tool (1), said connection comprising:

a first rod (4) sized for insertion into a drilling tool (1);

an anchor rod (6) bearing one of a drill bit and another anchor rod, the anchor rod having an outside diameter (Rd); and a transition piece (5) having a first end, a second end, and a non-movable interior inward-projecting annular rib intermediate the first and second ends, the first rod screwed into the first end of the transition piece, the anchor rod screwed into the second end of the transition piece, the anchor rod having an outside thread (9), the anchor rod having, at a free end screwed into the first end of the transition piece, a section (12) with an end length having a diameter (Ra) less than the outside diameter (Rd) of the anchor rod, the end length of the section being free of any outside thread, the free end of the section adjacently facing the interior annular rib of the transition piece, there being an annular empty inside space between the free end of the section and a first lateral annular surface (25) of the rib of the transition piece.

10. The connection of claim 9, wherein the transition sleeve is made of hardened steel.

11. The connection of claim 9, wherein the free end of the section contacts the first lateral annular surface of the rib.

12. The connection of claim 11, wherein a free end of the first rod contacts a second lateral annular surface of the rib.

13. A connection of an anchor rod (6) to a drilling tool (1), said connection comprising:

a first rod (4) sized for insertion into a drilling tool (1);

an anchor rod (6) bearing one of a drill bit and another anchor rod, the anchor rod having an outside diameter (Rd); and a transition piece (5) having a first end, a second end, and a non-movable interior, inward-projecting annular rib intermediate the first and second ends, and a passage extending between the first end and the second end;

the first rod coupled into the first end of the transition piece, the anchor rod screwed into the second end of the transition piece, the anchor rod having an outside thread (9), the outside thread having an outside diameter, and a section with a chamfered free end with a tapered diameter, the section being at the free end screwed into the first end of the transition piece, the section (12) having a diameter (Ra) less than the outside diameter (Rd) of the outside thread, the section being free of any outside thread along the entire length of the chamfered free end, the free end of the section facing the interior annular rib of the transition piece, there being an empty inside space between the free end of the section and a first lateral annular surface (25) of the rib of the transition piece.

14. The connection of claim 13, wherein the transition sleeve is made of hardened steel.

15. The connection of claim 13, wherein the free end of the section contacts the first lateral annular surface of the rib.

16. The connection of claim 15, wherein a free end of the first rod contacts a second lateral annular surface of the rib.

17. The connection of claim 13, wherein the first rod is screwed into the first end of the transition piece.

18. The connection of claim 13, wherein the section with the chamfered free end and the tapered diameter includes a constant-diameter cylindrical outside surface adjacent the tapered diameter.

19. The connection of claim 13, wherein the empty space has a greater volume than an amount of deformation of the section with the chamfered free end when the anchor rod is subjected to action of loads during rotary motion and percussive motion drilling.

20. The connection of claim 13, wherein the transition sleeve is made of a hardened steel, and the anchor rod is made of the hardened steel.

* * * * *